US006972105B2

(12) United States Patent
Boeckx et al.

(10) Patent No.: US 6,972,105 B2
(45) Date of Patent: Dec. 6, 2005

(54) ROTARY TABLET PRESS

(75) Inventors: Jurgen Boeckx, Steenokkerzell (BE); Dirk Christiaens, Roosdaal (BE); Jan Vogeleer, Bornem (BE)

(73) Assignee: Court Oy NV, Halle (BE)

( * ) Notice: Subject to any disclaimer, the term of this patent is extended or adjusted under 35 U.S.C. 154(b) by 139 days.

(21) Appl. No.: 10/401,703

(22) Filed: Mar. 31, 2003

(65) Prior Publication Data

US 2004/0191347 A1 Sep. 30, 2004

(51) Int. Cl.[7] ..... B30B 11/01

(52) U.S. Cl. ..... 264/239; 425/182; 425/193; 425/345; 425/353

(58) Field of Search ..... 425/193, 345, 425/182, 48, 353, 365; 264/239

(56) References Cited

U.S. PATENT DOCUMENTS

| | | | |
|---|---|---|---|
| 3,825,387 | A | 7/1974 | Gillman |
| 4,362,491 | A | 12/1982 | Livingstone |
| 4,988,275 | A | 1/1991 | Hinzpeter et al. |
| 5,004,413 | A | 4/1991 | Stopforth |
| 5,151,280 | A | 9/1992 | Arndt et al. |
| 5,509,763 | A | 4/1996 | Reinauer et al. |
| 5,722,806 | A | 3/1998 | Erickson et al. |
| 6,361,305 | B1 | 3/2002 | Hinzpeter et al. |

FOREIGN PATENT DOCUMENTS

| | | |
|---|---|---|
| JP | 4367398 | 12/1992 |
| JP | 8039297 | 2/1996 |
| JP | 11019799 | 1/1999 |
| WO | WO 02/074527 A1 | 9/2002 |

*Primary Examiner*—Robert Davis
*Assistant Examiner*—Thu Khanh T. Nguyen
(74) *Attorney, Agent, or Firm*—Sughrue Mion, PLLC

(57) ABSTRACT

A rotary tablet press comprises a rotary system constituted by a turret and a drive shaft arranged in a housing for rotation of the turret. The turret includes a die table and a number of punches are guided in the turret. The turret is connectable to the drive shaft by a coupling including a first coupling part and a second coupling part which are interconnectable by clamping elements engageable between the coupling parts by at least one pneumatic actuator situated in the rotary system.

12 Claims, 4 Drawing Sheets

ROTARY TABLET PRESS

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

The present invention relates to a rotary tablet press comprising a turret and a drive shaft arranged in the housing for rotation of the turret.

U.S. Pat. No. 5,004,413 discloses a rotary tablet press comprising a die table carried by bearings mounted on an intermediate axially extending portion of a spindle fixed stationary on the machine frame. The die table is driven through inter-engaging drive dogs by a pulley carried by bearings mounted on a lower, fixed end portion of the spindle. An upper end portion of the spindle is attached to a machine upper frame and comprises a fluid-operable piston which is downward displaceable axially in the spindle to engage an upper end face of the intermediate spindle portion in order to press a lower end face of this into engagement with an upper end face of the lower end portion of the spindle and thereby bring the drive dogs of the die table into engagement with the drive dogs of the pulley. The die table may be released from the machine frame by upward displacement of the piston in the upper end portion of the spindle and subsequently lifted out of engagement with the pulley by upward displacement of a fluid-operable piston arranged axially in the lower end portion of the spindle. However, due to the additional intermediate spindle portion with associated bearings carrying the die table, this design is rather complex and consequently costly.

BRIEF SUMMARY OF THE INVENTION

The object of the present invention is to provide a rotary tablet press of a simpler construction than known tablet presses.

The present invention relates to a rotary tablet press comprising a housing, a rotary system constituted by a turret and a drive shaft arranged in the housing for rotation of the turret, the turret comprising a die table, and a number of punches being guided in the turret, and at least a cam for cooperation with the punches in order to effect axial displacement of the punches by rotation of the turret, whereby the turret is connectable to the drive shaft by means of a coupling comprising a first coupling part and a second coupling part, said first and second coupling parts being interconnectable by means of clamping elements engageable between the coupling parts by means of at least one pneumatic actuator comprising an actuator piston displaceable in a cylinder arranged in the turret, whereby a pressure chamber delimited by the actuator piston in said cylinder is supplied with air through tubing releasably connected to an air supply In this way, the clamping force may be applied directly between the turret and the drive shaft, without the need for mechanically transferring the clamping force from the stationary housing of the tablet press to the rotary system.

A rather large actuator may be accommodated in the turret, thereby ensuring the provision of sufficient clamping force for the coupling, and the employment of a pneumatic actuator minimizes the risk that harmful fluid leaks into areas containing product.

In a further embodiment, the first coupling part comprises a mandrel extending axially therefrom, and the clamping elements are arranged in a cavity in the second coupling part so that they are displaceable to grip around the mandrel. The interaction between the clamping elements and the mandrel ensures that the two coupling parts are aligned coaxially.

In a further embodiment simple to manufacture, the gripping operation of the clamping elements is activated by displacement of an actuator spindle, which is driven by means of the actuator piston.

In a further embodiment, the clamping elements are located around the actuator spindle in a bore in the second coupling part, and each clamping element has a first end with an inward projection arranged in a peripheral groove of the actuator spindle and a second end with an inward oblique face and an outward projection with an abutment, whereby, in a retracted position of the actuator spindle, the oblique face may abut a corresponding conical face of the mandrel and the abutment may abut a wall of the bore in the second coupling part so that the mandrel is fixed centrally in the second coupling part, and whereby, in an advanced position of the actuator spindle, the outward projection of the clamping element may be received in a recess in the wall of the bore so that the mandrel is released by the clamping elements.

The first end of the clamping elements may be provided with an outward groove in which an elastic ring, such as an annular spring, is located in order to maintain the inward projection of the first end of the clamping elements in the peripheral groove of the actuator spindle.

In another embodiment, the first coupling part has a peripheral groove, and the second coupling part comprises a plurality of clamping elements, each clamping element being actuated by a separate pneumatic actuator and having a gripper adapted to engage the peripheral groove of the first coupling part. By providing the clamping elements at the periphery of the coupling, less clamping force has to be provided by each clamping element and consequently by each associated actuator in order to maintain the coupling parts connected during operation of the tablet press.

In still another embodiment, the coupling is constituted by a bayonet coupling, the clamping elements being integral parts of bayonet coupling parts. Thereby the coupling may be designed to be self-reinforcing so that the clamping force is increased automatically by rotation of the turret during operation of the tablet press.

In a further embodiment, the actuator is driven by means of pressurized air supplied from the housing via tubing comprising a rotary coupling. In this way, the connection between the air supply and the rotary system may be maintained during rotation of the turret, and no manual or automatic connection between the air supply and the rotary system has to be performed before the coupling may be operated in order to remove the turret from the drive shaft.

In a further embodiment, the first coupling part is provided on the drive shaft and the second coupling part is provided on the turret.

In a further embodiment, each coupling part is provided with a coaxially arranged toothed ring, said toothed rings being mutually engageable upon connection of the two coupling parts. The engagement between the toothed rings permits the transmission of sufficient torque from the drive shaft to the turret.

The present invention further relates to a method of mounting a turret of a rotary tablet press on a drive shaft of the press, the tablet press comprising a housing, a rotary system constituted by the turret and the drive shaft, the turret comprising a die table, and a number of punches being guided in the turret, and at least a cam for cooperation with the punches in order to effect axial displacement of the punches by rotation of the turret, whereby the turret is mounted on the drive shaft by means of a coupling comprising a first coupling part and a second coupling part.

The method according to the invention is characterized by interconnecting said first and second coupling parts by means of clamping elements and by engaging said clamping elements between the coupling parts by means of operating at least one pneumatic actuator, whereby an actuator piston comprised by the actuator is displaced in a cylinder arranged in the turret, whereby a pressure chamber delimited by the actuator piston in said cylinder is supplied with air from an air supply, and whereby the pressure chamber by means of tubing is connected releasably to the air supply before operating the actuator. Thereby the above-mentioned advantages are obtained.

In a further embodiment of the method according to the invention, the operation of the pneumatic actuator displaces an actuator spindle in a bore in the second coupling part from an advanced position to a retracted position, whereby the spindle displaces the clamping elements from a position, in which a mandrel extending axially from the first coupling part is releasable from the second coupling part, to a position, in which an oblique inward face of the clamping elements abuts a corresponding conical face of the mandrel and an outward abutment of the clamping elements abuts a wall of the bore in the second coupling part, whereby the mandrel is fixed centrally in the second coupling part.

BRIEF DESCRIPTION OF THE SEVERAL VIEWS OF THE DRAWING

The invention will be described in more detail below by means of examples of embodiments with reference to the schematic drawing, in which.

DETAILED DESCRIPTION OF THE INVENTION

Figure 1:
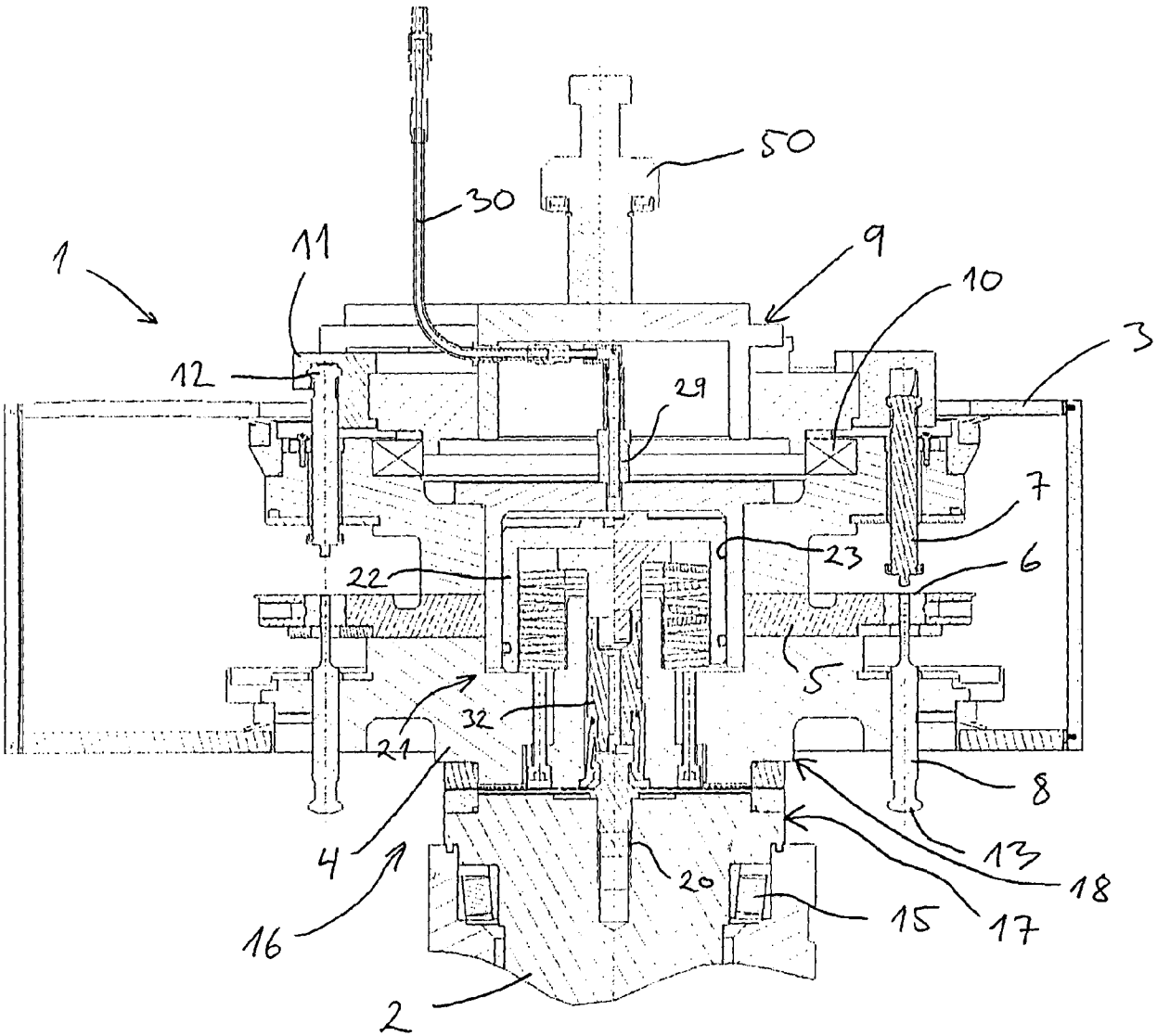
FIG. 1 is a sectional view of part of the rotary system of a rotary tablet press according to the invention.

FIG. 1 shows a compression unit 1 and part of a drive shaft 2 of a rotary tablet press for compression of a feedstock in the form of powder or granular material into tablets, compacts or the like. The tablet press is of a type suitable for use in the pharmaceutical industry, but the press according to the invention may as well be a so-called industrial press employed in the production of a variety of different products, such as vitamins, pet food, detergents, explosives, ceramics, batteries, balls, bearings, nuclear fuels, etc.

The compression unit 1 is detachably arranged in a not shown housing of the tablet press and comprises a stationary casing 3, in which is arranged a rotary turret 4. The turret 4 comprises a die table 5, in which a number of dies 6 are arranged circumferentially. Each die 6 is associated with an upper punch 7 and a lower punch 8 guided in the turret 4 in order to compress material in the die 6. The turret 4 is arranged rotatably in the casing 3 and by means of bearings 10 it supports stationary cams 11 cooperating with upper so-called mushroom heads 12 of the upper punches 7 in order to displace the punches 7 axially by rotation of the turret 4. The lower punches 8 are provided with similar mushroom heads 13 arranged in corresponding lower cams 14, which are not shown in FIG. 1, but are arranged in the housing of the tablet press, which will be described in greater detail below. The compression unit 1 comprises a not shown powder inlet releasably connected to a powder supply arranged in the tablet press housing as well as a not shown tablet outlet possibly releasably connected to a tablet chute arranged in the tablet press housing. Further, the compression unit possibly comprises other not shown releasable connections for dust extraction and die lubrication, among others.

The vertical drive shaft 2 is arranged rotatably in the tablet press housing by means of bearings 15 and is driven by means of a not shown drive motor in order to rotate the rotary turret 4. The turret 4 is releasably connected drivingly to the drive shaft 2 by means of a coupling 16 comprising a first coupling part 17 provided at an upper end of the drive shaft 2 and a second coupling part 18 provided in the rotary turret 4.

Figure 2:
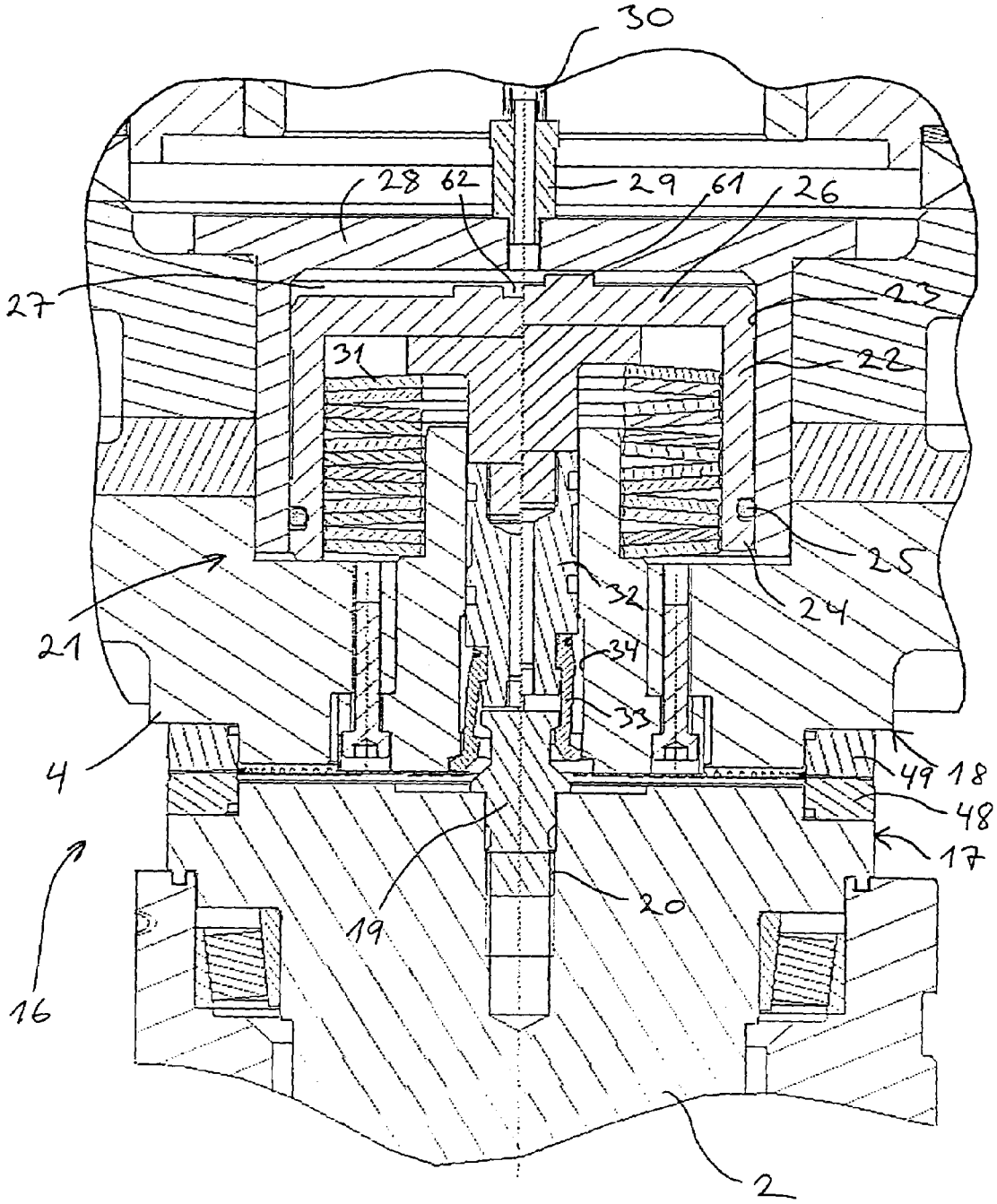
FIG. 2 is, on a larger scale, a sectional view of the coupling of the rotary system in FIG. 1.

FIG. 2 shows the coupling 16 on a larger scale. The first coupling part 17 comprises a mandrel 19 fixed axially in the upper end of the drive shaft 2 by means of threads 20 so that it extends from the upper end of the drive shaft 2.

The second coupling part 18 comprises a pneumatic actuator 21 having a piston 22 arranged displaceably in a cylinder 23 arranged coaxially in the rotary turret 4. The piston 22 has an outer peripheral wall 24 sealed against the cylinder 23 by means of an O-ring 25 and a top wall 26 that together with the cylinder 23 delimits a pressured chamber 27. In a top wall 28 of the cylinder 23 is mounted a rotary coupling 29 through which compressed air may be supplied from a supply tube 30 to the pressure chamber 27 in order to operate the actuator 21. The actuator piston 22 is spring-loaded towards an upper position shown in the part of FIG. 2 situated on the right side of the actuator centre line by means of a number of disc springs 31 arranged in a pile inside the outer wall 24 of the piston 22. A lower position of the actuator piston 22, which is reached when operating the actuator 21 by means of compressed air, is shown in the part of FIG. 2 situated on the left side of the actuator centre line. An actuator spindle 32 is arranged coaxially in and connected rigidly to the actuator piston 22 in order to displace a number of clamping elements 33 arranged around the actuator spindle 32 in a bore 34 of the second coupling part 18. The clamping elements 33 may be employed in a number of three, four or more.

A cylindrical stop 61 projects up from the centre of the top wall 26 of the actuator piston 22 in order to limit the upper position of the piston 22. The cylindrical stop 61 is provided with a diametrical recess 62 so that the air supply through the rotary coupling 29 will not be covered by the stop 61.

In the above-described embodiment the actuator 21 is operated by means of compressed air, but it may also be operated by means of hydraulic oil or by means of any suitable fluid, such as gas, liquid or any mixture of these.

Figure 3:
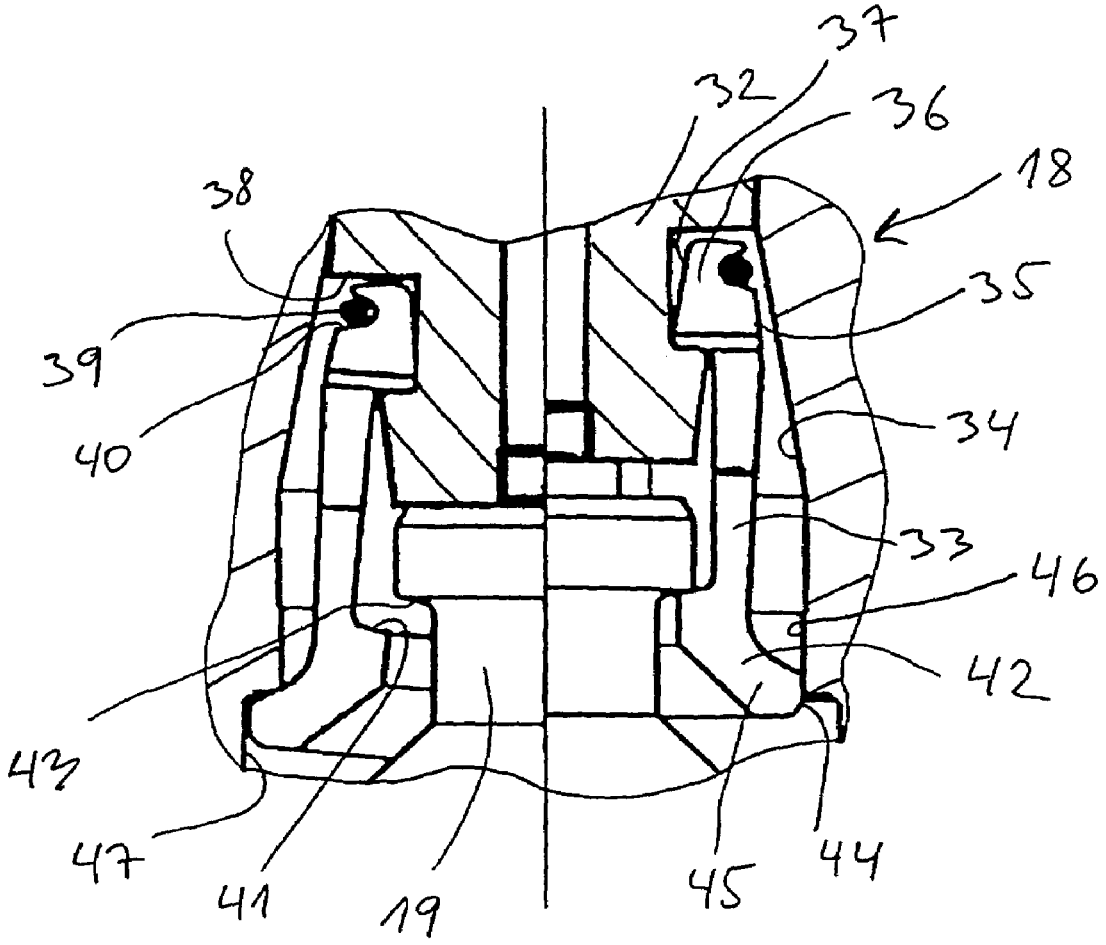
FIG. 3 shows a detail of the coupling shown in FIG. 2, and FIGS. 4, 5 and 6 are sectional views of different embodiments of the mounting of the lower cams.

FIG. 3 shows the clamping elements 33 of the second coupling part 18 in greater detail. Each clamping element 33 has a first end 35 provided with a projection 36 directed inwards in relation to the centre axis of the coupling and having an inward oblique face 37. The projection 36 is maintained in a peripheral groove 38 in the actuator spindle 32 by means of an annular spring 39 passing through an outward groove 40 of the first end of each clamping element 33. In the upper position of the actuator piston 22, in which the actuator spindle 32 is in a retracted position, as shown on the right side of FIGS. 2 and 3, an inward oblique face 41 of a second end 42 of each clamping element 33 abuts a corresponding conical surface 43 of the mandrel 19 and an abutment 44 of an outward projection 45 of the second end 42 of each clamping element 33 abuts a wall 46 of the bore 34 in the second coupling part 18, whereby the mandrel 19 is fixed centred in the second coupling part 18.

In the lower position of the actuator piston 22, in which the actuator spindle 32 is in an advanced position, as shown on the left side of FIGS. 2 and 3, the clamping elements 33 are displaced to a position, in which the second end 42 of the clamping elements 33 are displaced outwards in the radial direction of the coupling 16, sufficiently for the conical face 43 of the mandrel 19 to pass out between the clamping elements 33 and out of the second coupling part 18. In said position, the abutment 44 of the clamping elements 33 abuts a recess 47 in the bore 34 of the second coupling part 18. As may be seen in FIG. 3, in the retracted position of the actuator spindle 32, the oblique face 37 of the first end 35 of the clamping elements 33 abuts the bottom of the groove 38 in the actuator spindle 32 at its lower edge only, whereas the oblique face 37 in the advanced position of the actuator spindle 32 abuts the bottom of the groove 38 over substantially its entire area. In other words, the clamping elements 33 are tilted between the closed and open positions by means of displacement of the actuator spindle 32, assisted by the spring force of the annular spring 39.

In order to transfer the torque from the drive shaft 2 to the rotary turret 4, the first coupling part 17 is provided with a toothed ring 48 which may engage with a corresponding toothed ring 49 on the second coupling part 18.

On the top of the compression unit on a cover 9 is provided a shaft 50 which may be moved by means of a manipulator arranged in the housing of the compression unit in order to lift the compression unit 1 up from the drive shaft 2 and horizontally out of the tablet press in order to clean or exchange the compression unit. Before removing the compression unit, the tubing 30 is released from the air supply in the housing. However, during operation of the tablet press, the tubing 30 may be maintained connected to the air supply due to the rotary coupling 29.

Different embodiments of the coupling 16 are possible, it would for instance be possible to provide the second coupling part 18 on the drive shaft 2 and the first coupling part 17 on the rotary turret 4, i.e. the actuator 21 would be situated in the drive shaft 2. The clamping elements 33 may have a different configuration, they may for instance be arranged at the periphery of the drive shaft 2 and may possibly each be operated by means of a separate actuator. Obviously, the coupling 16 according to the invention may also be employed in tablet presses without an enclosed compression unit as shown in the figures.

Figure 6:
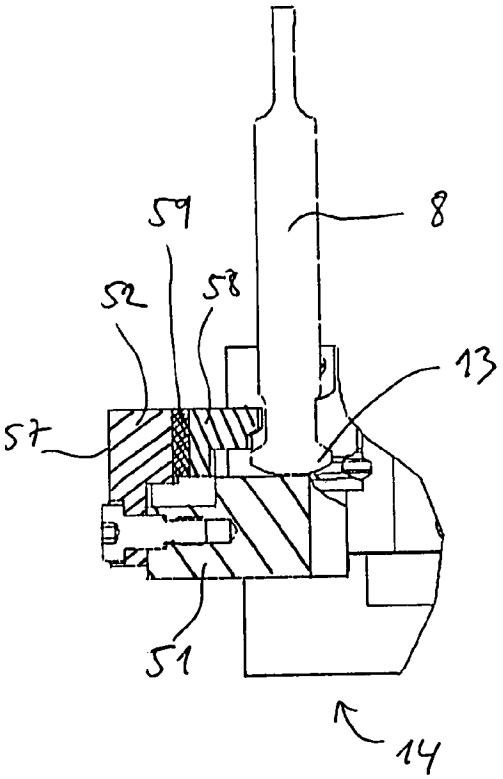
Figure 5:
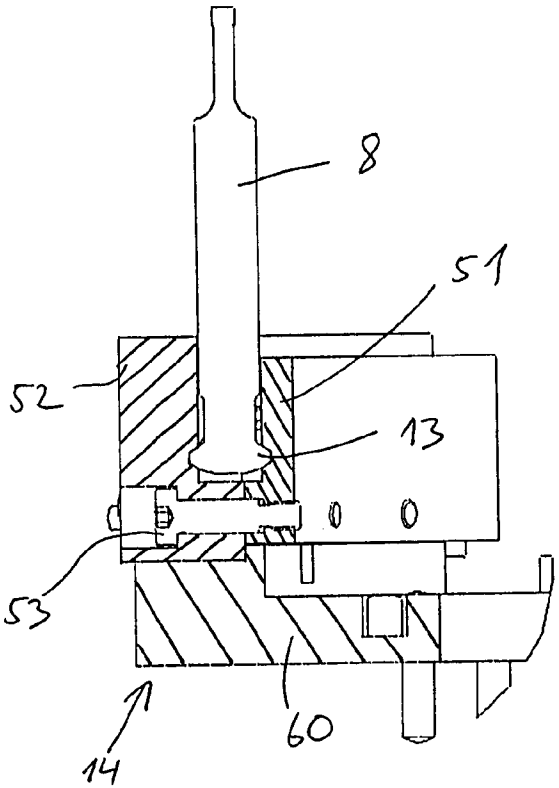
Figure 4:
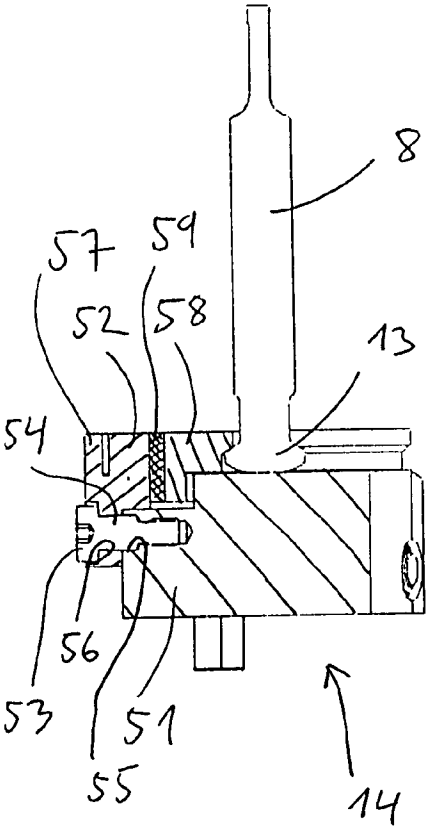

FIGS. 4, 5 and 6 show how the lower cams 14 may be provided releasable in the housing of the tablet press in order to release the lower mushroom heads 13 of the lower punches 8 from the tablet press housing before removal of the compression unit 1 from the tablet press housing.

FIG. 4 shows a single-acting cam 14, i.e. a cam which grips over the mushroom head 13 at only one side of the head. The cam 14 is composed of a first cam block 51 fixed in the tablet press housing and a second cam block 52 which is mounted on the first cam block 51 by means of a shoulder screw 53. The shoulder screw 53 ensures accurate positioning of the second cam block 52 in relation to the first cam block 51 by means of its shoulder 54 which fits exactly into both a toleranced bore 55 of the first cam block 51 and a toleranced bore 56 of the second cam block 52. The second cam block 52 is divided into a first part 57 and a second part 58 by means of an intermediate rubber layer 59 in order to take up small tolerances between the first and second parts 57, 58. The second part 58 grips over one side of the mushroom head 13 of the lower punch 8. The first part 57 may suitably be made of corrosion-resistant steel and the second part 58 may suitably be made of bronze.

FIG. 5 shows a double-acting cam that has a first cam block 51 gripping over the right side of the mushroom head 13 and a second cam block 52 gripping over the left side of the mushroom head 13. The two cam blocks 51, 52 are interconnected releasably by means of a shoulder screw 53 in the same way as the single-acting cam shown in FIG. 4. The double-acting cam shown in FIG. 5 does not comprise an intermediate rubber layer. The first cam block 51 is by means of vertical screws fixed to a frame part 60 of the tablet press housing. As it is known in the art, a double-acting cam is employed in such parts of the operating cycle where the punch head 13 is submitted to high vertical acceleration forces.

FIG. 6 shows a different configuration of the single-acting cam shown in FIG. 4. The releaseable mounting of the cam blocks 51, 52 by means of the shoulder screws 53 is in itself an invention which may, of course, be employed independently of the coupling 16 according to the invention.

What is claimed is:

1. A rotary tablet press comprising a housing, a rotary system constituted by a turret and a drive shaft arranged in the housing for rotation of the turret, the turret comprising a die table, and a number of punches being guided in the turret, and at least a cam for cooperation with the punches in order to effect axial displacement of the punches by rotation of the turret, whereby the turret is connectable to the drive shaft by means of a coupling comprising a first coupling part and a second coupling part, said first and second coupling parts being interconnectable by means of clamping elements engageable between the coupling parts by means of at least one pneumatic actuator comprising an actuator piston displaceable in a cylinder arranged in the turret, whereby a pressure chamber delimited by the actuator piston in said cylinder is supplied with air through tubing releasably connected to an air supply.

2. A rotary tablet press according to claim 1, wherein the first coupling part comprises a mandrel extending axially therefrom, and the clamping elements are arranged in a cavity in the second coupling part so that they are displaceable to grip around the mandrel.

3. A rotary tablet press according to claim 2, wherein the gripping operation of the clamping elements is activated by displacement of an actuator spindle, which is driven by means of the actuator piston.

4. A rotary tablet press according to claim 3, wherein the clamping elements are located around the actuator spindle in a bore in the second coupling part, and each clamping element has a first end with an inward projection arranged in a peripheral groove of the actuator spindle and a second end with an inward oblique face and an outward projection with an abutment, whereby, in a retracted position of the actuator spindle, the oblique face may abut a corresponding conical face of the mandrel and the abutment may abut a wall of the bore in the second coupling part so that the mandrel is fixed centrally in the second coupling part, and whereby, in an advanced position of the actuator spindle, the outward projection of the clamping element may be received in a recess in the wall of the bore so that the mandrel is released by the clamping elements.

5. A rotary tablet press according to claim 4, wherein the first end of the clamping elements is provided with an outward groove in which is located an elastic ring, such as an annular spring, in order to maintain the inward projection of the first end of the clamping elements in the peripheral groove of the actuator spindle.

6. A rotary tablet press according to claim 4, wherein the first coupling part is provided on the drive shaft and the second coupling part is provided on the turret.

7. A rotary tablet press according to claim 1, wherein the first coupling part has a peripheral groove, and the second coupling part comprises a plurality of clamping elements, each clamping element being actuated by a separate pneumatic actuator and having a gripper adapted to engage the peripheral groove of the first coupling part.

8. A rotary tablet press according to claim 1, wherein the coupling is constituted by a bayonet coupling, the clamping elements being integral parts of bayonet coupling parts.

9. A rotary tablet press according to claim 1, wherein the actuator is driven by means of pressurized air supplied from the housing via tubing comprising a rotary coupling.

10. A rotary tablet press according to claim 1, wherein each coupling part is provided with a coaxially arranged toothed ring, said toothed rings being mutually engageable upon connection of the two coupling parts.

11. A method of mounting a turret of a rotary tablet press on a drive shaft of the press, the tablet press comprising a housing, a rotary system constituted by the turret and the drive shaft, the turret comprising a die table, and a number of punches being guided in the turret, and at least a cam for cooperation with the punches in order to effect axial displacement of the punches by rotation of the turret, whereby the turret is mounted on the drive shaft by means of a coupling comprising a first coupling part and a second coupling part, by interconnecting said first and second coupling parts by means of clamping elements and by engaging said clamping elements between the coupling parts by means of operating at least one pneumatic actuator, whereby an actuator piston comprised by the actuator is displaced in a cylinder arranged in the turret, whereby a pressure chamber delimited by the actuator piston in said cylinder is supplied with air from an air supply in the housing, and whereby the pressure chamber by means of tubing is connected releasably to the air supply before operating the actuator.

12. A method of mounting according to claim 11, whereby the operation of the pneumatic actuator displaces an actuator spindle in a bore in the second coupling part from an advanced position to a retracted position, whereby the spindle displaces the clamping elements from a position, in which a mandrel extending axially from the first coupling part is releasable from the second coupling part, to a position, in which an oblique inward face of the clamping elements abuts a corresponding conical face of the mandrel and an outward abutment of the clamping elements abuts a wall of the bore in the second coupling part, whereby the mandrel is fixed centrally in the second coupling part.

* * * * *

UNITED STATES PATENT AND TRADEMARK OFFICE

CERTIFICATE OF CORRECTION

PATENT NO. : 6,972,105 B2 
DATED : December 6, 2005
INVENTOR(S) : Jurgen Boeckx, Dirk Christiaens and Jan Vogeleer It is certified that error appears in the above-identified patent and that said Letters Patent is hereby corrected as shown below:

Title page,
Item [73], Assignee, change "Court Ox NV" to -- Courtoy NV --.

Signed and Sealed this

Twenty-fifth Day of April, 2006

JON W. DUDAS
*Director of the United States Patent and Trademark Office*